US009908131B2

(12) United States Patent
Alluigi

(10) Patent No.: US 9,908,131 B2
(45) Date of Patent: Mar. 6, 2018

(54) TRIGGER DISPENSER DEVICE

(71) Applicant: GUALA DISPENSING S.p.A., Alessandria (IT)

(72) Inventor: Riccardo Alluigi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 0 days.

(21) Appl. No.: 15/024,801

(22) PCT Filed: Oct. 10, 2014

(86) PCT No.: PCT/IB2014/065199
§ 371 (c)(1),
(2) Date: Mar. 24, 2016

(87) PCT Pub. No.: WO2015/068065
PCT Pub. Date: May 14, 2015

(65) Prior Publication Data

US 2016/0214130 A1 Jul. 28, 2016

(30) Foreign Application Priority Data

Nov. 5, 2013 (IT) ..... BS2013A0159

(51) Int. Cl.
*B05B 11/00* (2006.01)
*B05B 15/00* (2018.01)

(52) U.S. Cl.
CPC ..... *B05B 11/3057* (2013.01); *B05B 11/0016* (2013.01); *B05B 11/3011* (2013.01); *B05B 11/3045* (2013.01); *B05B 11/3047* (2013.01); *B05B 15/005* (2013.01)

(58) Field of Classification Search
CPC ..... B05B 11/3057; B05B 11/0016; B05B 11/3011; B05B 11/3045; B05B 11/3047; B05B 15/005
See application file for complete search history.

(56) References Cited

U.S. PATENT DOCUMENTS 4,728,009 A * 3/1988 Schmidt ..... B05B 11/0016 222/321.9
5,299,717 A * 4/1994 Geier ..... B05B 11/3011 222/340
5,318,206 A * 6/1994 Maas ..... B05B 11/0029 222/340
5,439,141 A 8/1995 Clark et al.
5,709,325 A * 1/1998 Renault ..... B05B 11/0016 222/383.1

(Continued)

FOREIGN PATENT DOCUMENTS

CN 103 608 122 A 2/2014
DE 83 11 430 U1 9/1983

(Continued)

OTHER PUBLICATIONS

International Search Report for corresponding International Patent Application No. PCT/IB2014/065199 dated Feb. 19, 2015.

*Primary Examiner* — Frederick C Nicolas
(74) *Attorney, Agent, or Firm* — Merchant & Gould P.C.

(57) ABSTRACT

A pre-assembled dispenser head (10) for a dispenser device (1) of a liquid includes a frame (14), a connector (60) having a suction tube (62) for the liquid. The connector (60) is connected to the frame (14) by a snap-free connection.

3 Claims, 14 Drawing Sheets

(56) References Cited

U.S. PATENT DOCUMENTS

| | | | | |
|---|---|---|---|---|
| 5,730,335 | A | 3/1998 | Maas et al. | |
| 5,887,763 | A | 3/1999 | Foster | |
| 5,906,301 | A | 5/1999 | Foster | |
| 8,256,648 | B2 * | 9/2012 | Maas | B05B 11/0062 222/341 |
| 8,870,033 | B2 * | 10/2014 | Alluigi | B05B 11/0016 222/340 |
| 9,579,675 | B2 * | 2/2017 | Foster | B05B 11/3011 |
| 2012/0234870 | A1 | 9/2012 | Good et al. | |

FOREIGN PATENT DOCUMENTS

| | | | |
|---|---|---|---|
| WO | 2012/035445 | A1 | 3/2012 |
| WO | 2013/080061 | A1 | 6/2013 |

* cited by examiner

TRIGGER DISPENSER DEVICE

This application is a National Stage Application of PCT/IB2014/065199, filed 10 Oct. 2014, which claims benefit of Serial No. BS2013A000159, filed 5 Nov. 2013 in Italy, and which applications are incorporated herein by reference. To the extent appropriate, a claim of priority is made to each of the above disclosed applications.

BACKGROUND OF THE INVENTION

The object of the present invention is a manual trigger dispenser device, primarily for liquids, for example for the hygiene of the house, the deodorization of environments, the treatment of fabrics before ironing, and the like.

Such devices have experienced a huge spreading, as is evident by looking at the shelves of supermarkets, especially for their ease of use and functionality. Many hundreds of millions of pieces are produced every year.

For the production to be economically advantageous, the plants for the production of the components of such devices, as well as those for the assembly, must be able to produce and assemble high volumes, carrying out the single operations in very short time.

For this reason, even minor improvements in the production process of the components or in the assembly process may lead to significant economic advantages.

Precisely for productivity and assembly reasons, some dispenser heads, intended to be plugged or screwed onto the bottle, comprise a frame, which supports the components intended for the suction and dispensing of the liquid, and a connector, bearing the liquid suction duct.

The connection methods between the connector and the frame of the dispenser head are of primary importance, since they are essential to implement the connection between the two components in a short time and in such a way that such a connection is extremely reliable.

Many embodiments of dispenser heads with frame and connector are known; for example, an embodiment is known from document US-A1-2012/0234870 and provides for the snap connection between the connector and the frame, through peripheral tabs.

SUMMARY OF THE INVENTION

The present invention relates to a further connection method between the frame and the connector, able to improve the production processes of the components and the assembly process of the device.

BRIEF DESCRIPTION OF THE DRAWINGS

The features and the advantages of the dispenser device according to the present invention will appear more clearly from the following description, made by way of an indicative and non-limiting example with reference to the following figures, in which:

FIG. 11 shows a sectional view of a dispenser head of a dispenser device according to a further embodiment of the present invention;

FIG. 12 shows an enlargement of detail XII in FIG. 11;

DETAILED DESCRIPTION OF THE PREFERRED EMBODIMENTS

Figures 1, 2:
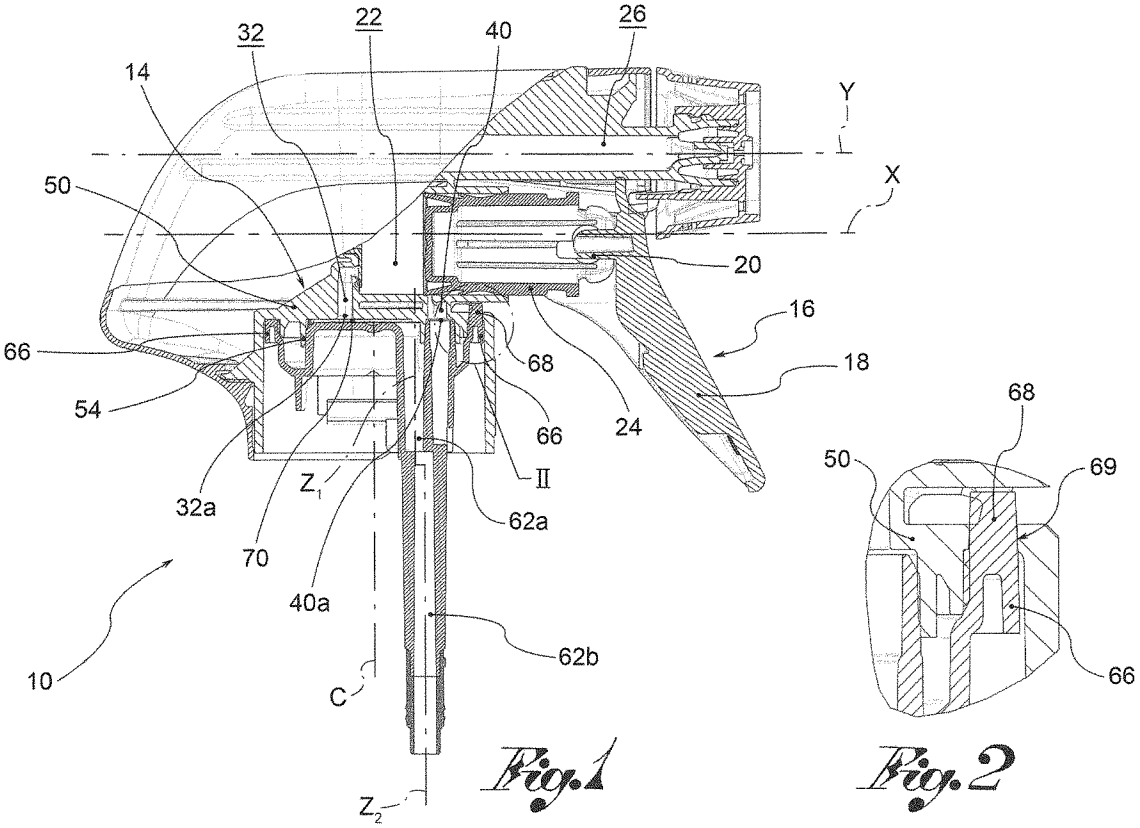
FIG. 1 shows a sectional view of a dispenser head of a dispenser device according to an embodiment of the present invention.
FIG. 2 shows an enlargement of detail II in FIG. 1.

With reference to the accompanying figures, reference numeral 1 globally indicates a manual trigger dispenser device. Device 1 comprises a bottle 2 consisting of an annular side wall 4, and a neck 6, placed at the end of the annular wall, having an aperture for accessing a compartment inside bottle 2. A neck axis C, central relative to the access aperture of neck 6, is defined for neck 6.

Device 1 further comprises a dispenser head 10, generally pre-assembled, mechanically applicable to bottle 2, and in particular applicable to neck 6. For example, head 10 is applied via a threaded connection or a bayonet coupling.

Head 10 comprises a frame 14, usually made in a single piece, by plastic moulding, intended to support the components that allow the suction and dispensing of the liquid.

Head 10 comprises a trigger 16 operable by the operator to dispense the liquid. Trigger 16 generally comprises a handle portion 18 adapted to be pressed by a user's fingers, and an extension 20, generally integral with the handle portion 22.

Trigger 16 is supported by frame 14, for example hinged thereto or coupled in a translatable manner thereto.

Head 10 further comprises a pressure chamber 22 of variable volume by the action of trigger 16.

For example, head 10 comprises a piston 24, translatable within the pressure chamber 22, for example along a piston axis X, under the action of trigger 16, to which it is connected via extension 20.

Preferably, the piston axis X is incident to the neck axis C, for example perpendicular thereto. According to further alternative embodiments (not shown), the piston axis X is parallel to the neck axis C.

Preferably, chamber 22 is formed within frame 14.

Head 10 further comprises a dispenser conduit 26 adapted to be placed at one end in communication with the pressure chamber 22, and at the opposite end in communication with the outside environment.

The dispenser conduit 26 extends along a dispensing axis Y.

Preferably, the dispensing axis Y is parallel to the piston axis X. According to further alternative embodiments (not shown), the piston axis Y is incident, for example orthogonal to the piston axis X.

Preferably, the dispenser conduit 26 is formed within frame 14.

Head 10 further comprises a nozzle 28, preferably rotatable about the dispensing axis Y by manual action of the user, applied at the end of the dispenser conduit 26 opposite to the one in communication with the pressure chamber 22.

The dispenser head 10 further comprises valve dispenser means (not shown), arranged between the pressure chamber 22 and the dispenser conduit 26, sensitive to the pressure of the liquid in the pressure chamber 22, adapted to allow the transit of the liquid from the pressure chamber 22 to the dispenser conduit 26 when the pressure in the pressure chamber 22 is higher than a maximum threshold pressure and adapted to prevent said transit when the pressure in the pressure chamber 22 is lower than a minimum threshold pressure.

Preferably, the valve dispenser means comprise a membrane structure, and are preferably applied to frame 14.

For example, frame 14 comprises a dispenser valve compartment 30, upstream of the dispenser conduit 26, within which said dispenser conduit 26 flows.

Moreover, head 10 comprises a suction conduit 32 adapted to be placed at one downstream end in communication with the pressure chamber 22, and at the opposite upstream end with the compartment inside the bottle.

Preferably, the suction conduit 32 is formed within frame 14.

Moreover, the dispenser head 10 further comprises valve suction means (not shown), arranged between the pressure chamber 22 and the suction conduit 32, sensitive to the pressure of the liquid in the pressure chamber 22, adapted to allow the transit of the liquid from the bottle to the pressure chamber 22 when a suitable vacuum occurs in the pressure chamber 22 and adapted to prevent said transit when the vacuum in the pressure chamber 22 is not suitable.

Preferably, the valve suction means comprise a membrane structure, and are preferably applied to frame 14.

For example, frame 14 comprises a bottom wall 34, which delimits the pressure chamber 22, the wall towards which piston 24 moves during a liquid dispensing step being provided with a coupling system 36 for the valve suction means.

Head 10 further comprises a venting conduit 40 adapted to put the external environment in communication with the compartment within the bottle. Preferably, the venting conduit 40 is formed within frame 14.

In particular, head 10 comprises venting means, for example integrated with piston 24, cooperating with the venting conduit 40 and adapted to allow the passage of air through the venting conduit 40 from the external environment towards the compartment inside the bottle during a liquid suction step from the bottle to the pressure chamber 22 and adapted to obstruct the passage of liquid through the venting conduit 40 from the bottle to the outside.

Frame 14 comprises an interface wall 50 intended to engage with a connector 60 of head 10. The interface wall 50, on the side facing connector 60, has an interface surface 52, on which the suction conduit 32 flows via a suction mouth 32*a* and preferably the venting conduit 40 flows via a venting mouth 40*a*.

Moreover, the interface wall 50 comprises a peripheral annular portion 51, radially external to the suction mouth 32*a* and to the venting mouth 40*a*.

Connector 60 comprises a suction tube 62 elongated mainly along the neck axis C, so as to directly draw the liquid into the bottle or insert into a tube integrated into the bottle wall, such as described for example in WO-A1-2012/035445.

Preferably, the suction tube 62 is offset from the neck axis C of the bottle. According to further alternative embodiments (not shown), the suction tube 62 is coaxial to the neck axis C.

According to a preferred embodiment, the suction tube 62 internally includes two suction stretches 62*a*, 62*b*, the first stretch 62*a*, proximal to the interface wall 50 of frame 14, having a first axis Z1, and the second stretch 62*b*, distal to the interface wall 50 of frame 14 and in communication with the first stretch 62*a*, having a second axis Z2. The two axes Z1, Z2 are parallel and offset, preferably so that the first axis Z1 is proximal to the neck axis C and the second axis Z2 is distal to the neck axis C.

Connector 60, made as a component separate from frame 14, is applied to the interface wall 50 so as to form an intermediate compartment 70 between the suction conduit 32 and the suction tube 62, preferably mutually offset. Connector 60 sealingly engages with a sealing wall 54 projecting from the interface surface 52 of frame 14.

Preferably, connector 60 has a prominence 72, having an upper surface 74, which faces the interface surface 52 of the frame. The intermediate compartment 70 is at least partly formed between the upper surface 74 of prominence 72 and the interface surface 52 of frame 14.

Moreover, preferably, connector 60 comprises a venting tube 64, preferably attached to the suction tube 62, adapted to engage at one end with the venting conduit 40 of frame 14, communicating with the compartment inside the bottle.

Moreover, connector 60 comprises an annular wall 66, for example peripheral, i.e. such as to be radially external to the suction tube 62 and/or to the venting tube 64.

According to the invention, the connector is engaged to the frame by means of a snap-free connection, either reversible or irreversible.

Figure 3:
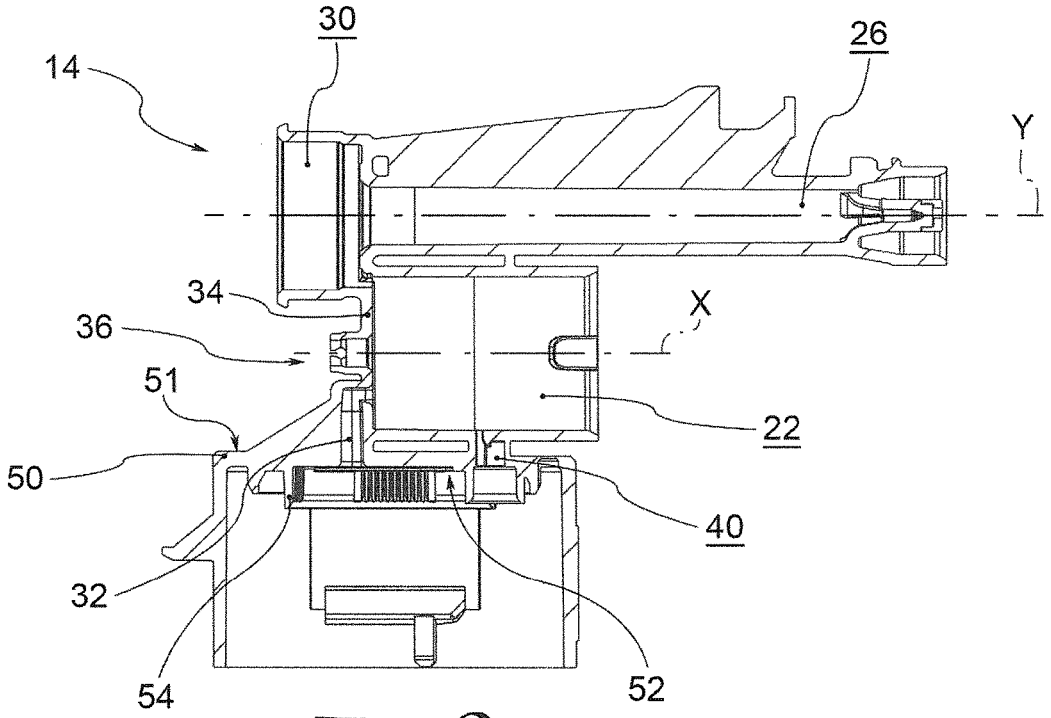
FIG. 3 shows a sectional view of a frame of the dispenser head in FIG. 1.
Figure 4:
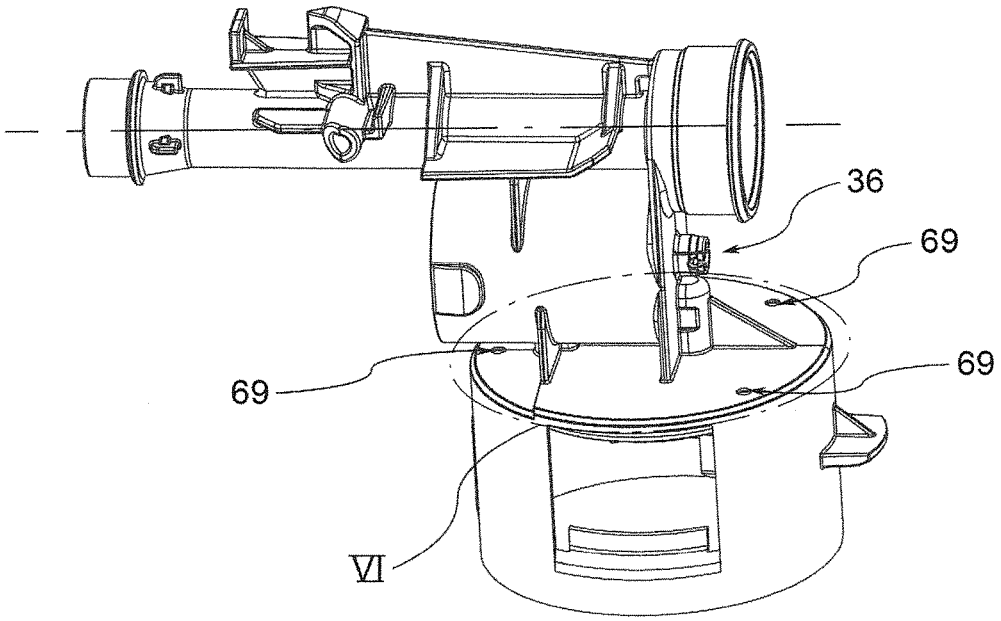
FIG. 4 shows a top view of the frame in FIG. 3.
Figure 5:
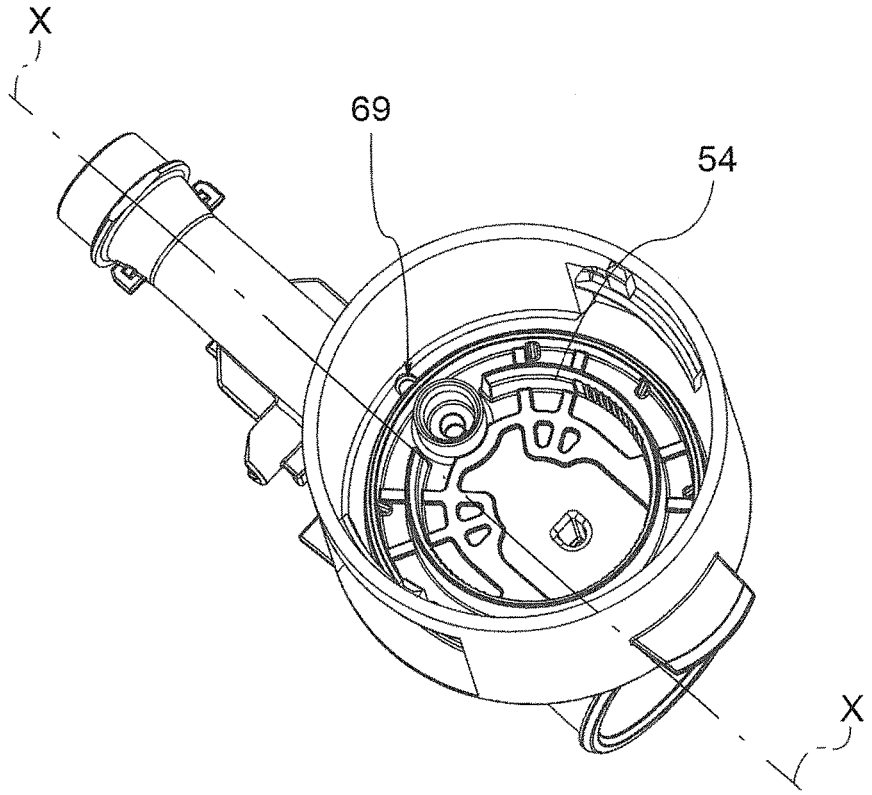
FIG. 5 shows a bottom view of the frame in FIG. 4.
Figure 6:
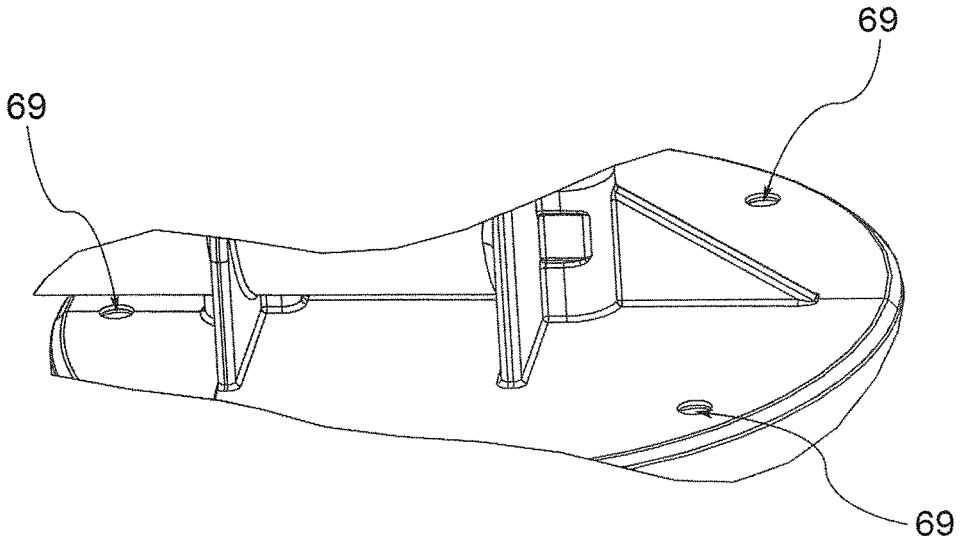
FIG. 6 shows an enlargement of detail VI in FIG. 5.
Figure 9:
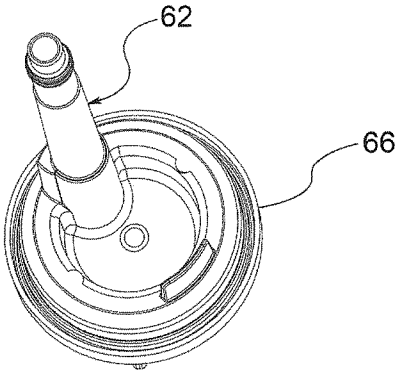
FIG. 9 shows a bottom view of the connector in FIG. 8.
Figure 10:
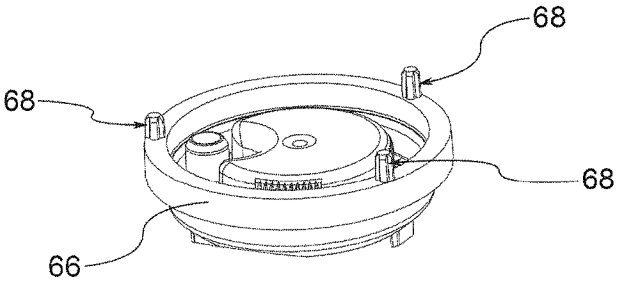
FIG. 10 shows an enlargement of detail X in FIG. 9.
Figure 8:
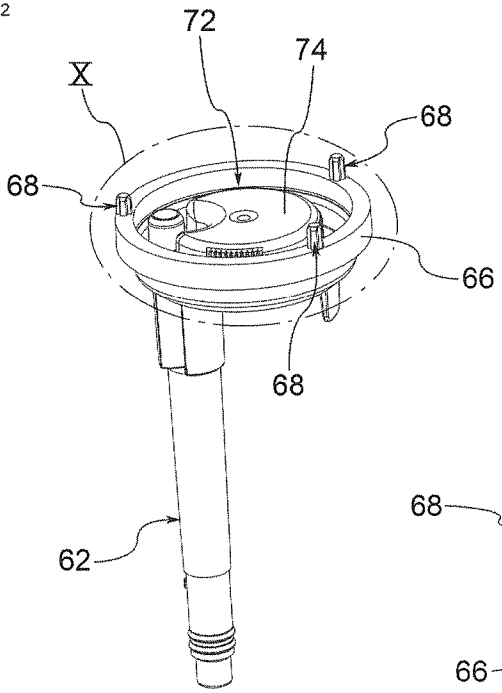
FIG. 8 shows a top view of the connector in FIG. 7.
Figure 7:
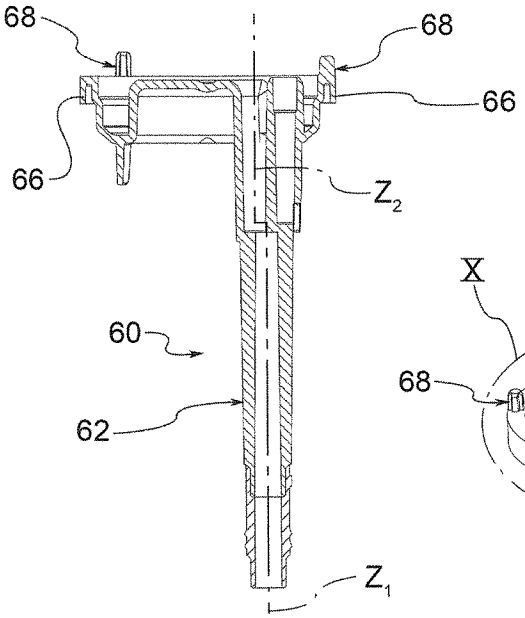
FIG. 7 shows a sectional view of a connector of the dispenser head in FIG. 1.
Figures 1, 2:
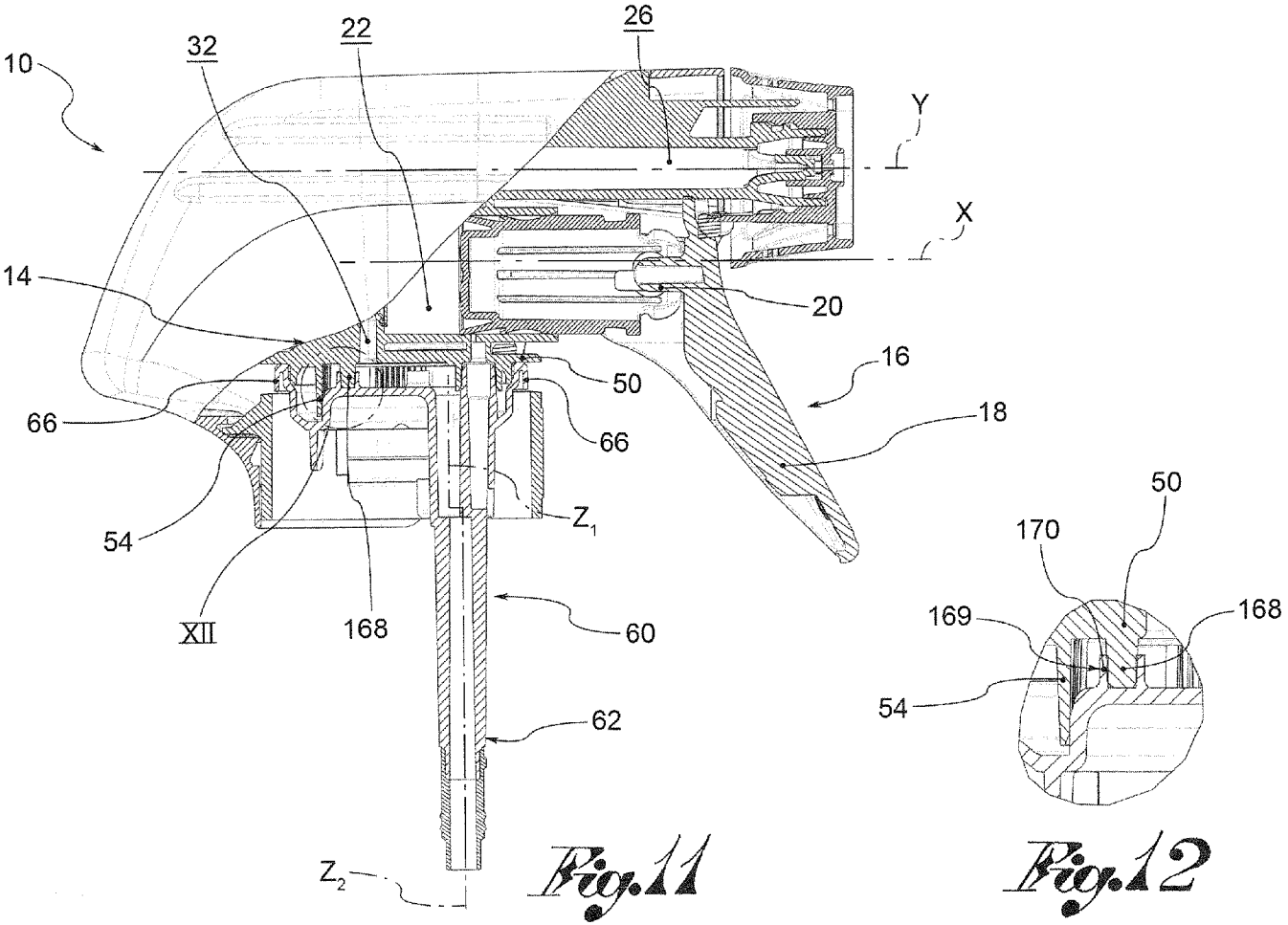
Figure 15:
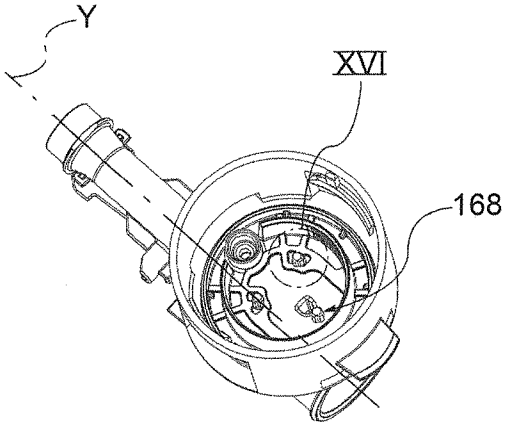
FIG. 15 shows a bottom view of the frame in FIG. 14.
Figure 16:
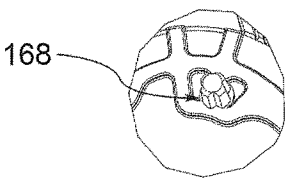
FIG. 16 shows an enlargement of detail XVI in FIG. 15.
Figure 14:
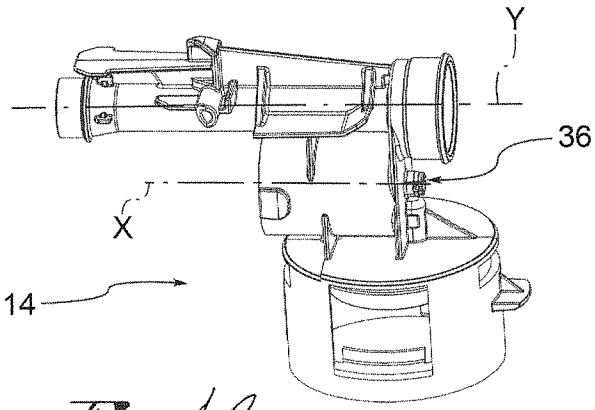
FIG. 14 shows a top view of the frame in FIG. 13.
Figure 13:
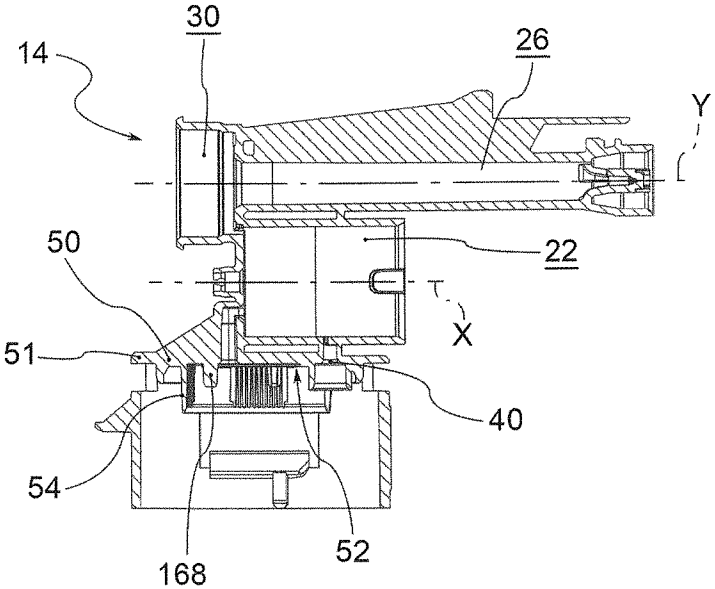
FIG. 13 shows a sectional view of a frame of the dispenser head in FIG. 11.
Figure 19:
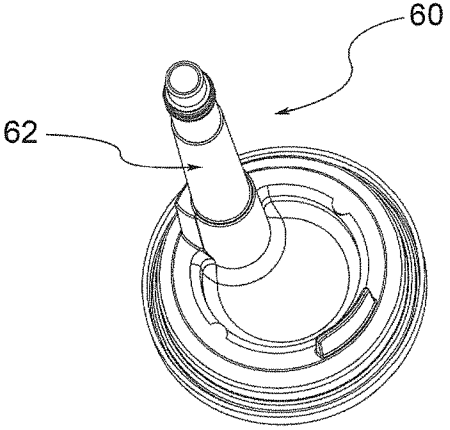
FIG. 19 shows a bottom view of the connector in FIG. 18.
Figure 20:
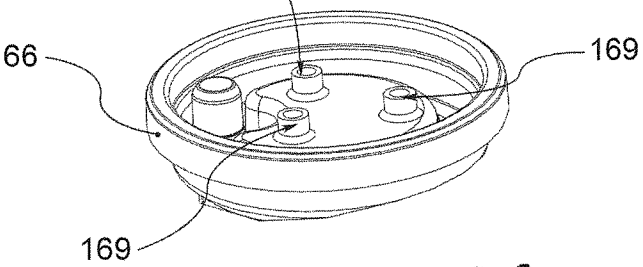
FIG. 20 shows an enlargement of detail XX in FIG. 19.
Figure 18:
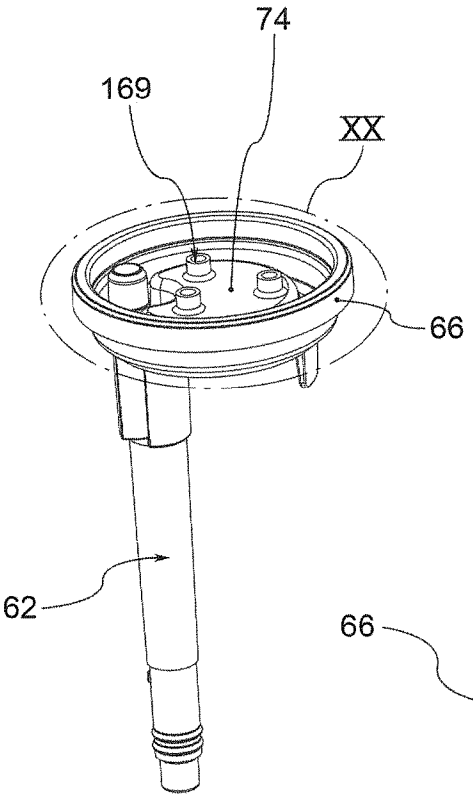
FIG. 18 shows a top view of the connector in FIG. 17.
Figure 17:
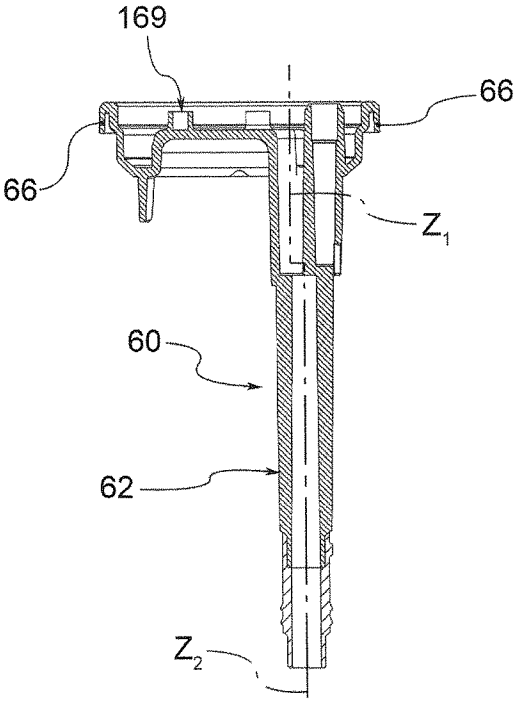
FIG. 17 shows a sectional view of a connector of the dispenser head in FIG. 11.

In particular, according to one embodiment of the invention, the connector is engaged to the frame by means of a reversible interference snap-free connection (FIGS. 1 to 20).

For example, according to a variant (FIGS. 1 to 10), connector 60 comprises at least one pin 68 projecting axially from the annular wall 66 and adapted to engage by interference with frame 14, and in particular with the interface wall 50 of said frame.

In other words, pins 68 are arranged radially externally to prominence 72.

Preferably, connector 60 comprises three pins 68, equally angularly spaced and preferably arranged with their respective central axes on the same imaginary circumference.

Correspondingly, frame 14 comprises at least one engagement hole 69, for example made in the interface wall 50, for example passing through said interface wall 50.

Preferably, said engagement holes 69 are made through the peripheral annular portion 51 of the interface wall 50 of frame 14.

In order to obtain the interference coupling, pins 68 have a slightly tapered shape away from the annular wall 66 and, correspondingly, the engagement holes 69 are preferably countersunk so that the insertion of the pins forms a structural interference adapted to retain connector 60 to frame 14.

According to a further variant (FIGS. 11 to 20), frame 14 comprises at least one pin 168 projecting from the interface wall 50, and in particular projecting from the interface surface 52, and adapted to engage by interference with connector 60, and in particular with prominence 72 of said connector 60.

Preferably, frame 14 comprises three pins 168, equally angularly spaced, preferably arranged with their respective main axes on the same imaginary circumference, and preferably arranged radially inside the sealing wall of frame 14. Preferably, pins 169 are shaped as a cross vault.

Correspondingly, preferably, connector 60 comprises at least one engagement seat 169, for example obtained by an annular raised portion 170 projecting from the upper surface 74 of prominence 72.

In order to obtain the interference coupling, pins 168 have a slightly tapered shape away from the interface wall 50 and, correspondingly, the engagement seats 169 are preferably countersunk so that the insertion of the pins forms a structural interference adapted to retain connector 60 to frame 14.

Figures 21, 22:
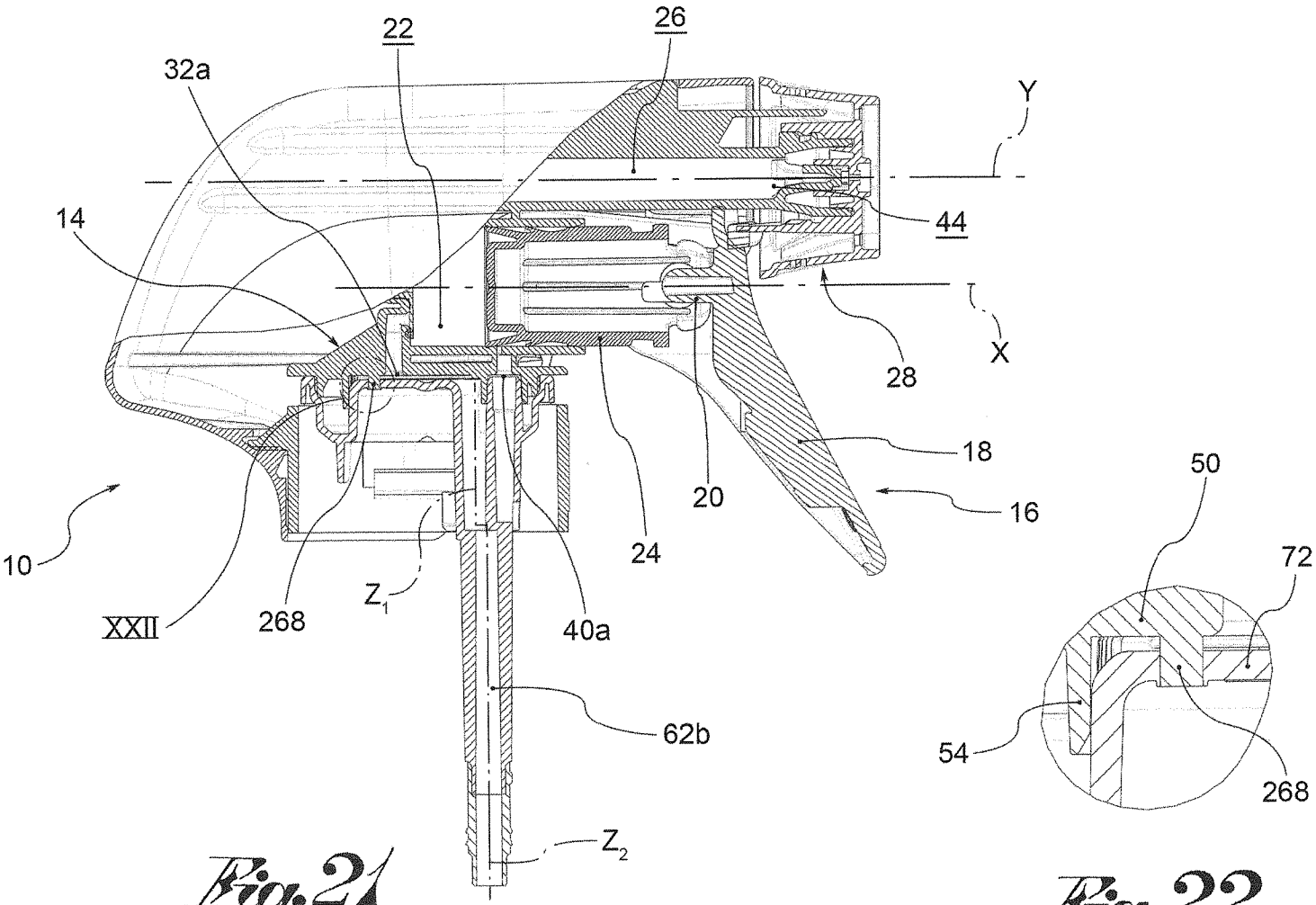
FIG. 21 shows a sectional view of a dispenser head of a dispenser device according to a still further embodiment of the present invention.
FIG. 22 shows an enlargement of detail XXII in FIG. 21.
Figure 24:
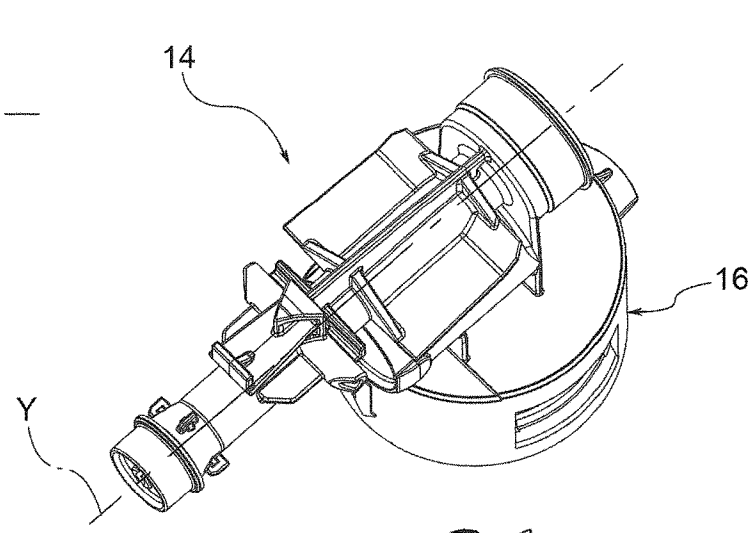
FIG. 24 shows a top view of the frame in FIG. 23.
Figure 26:
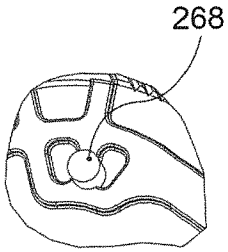
FIG. 26 shows an enlargement of detail XXVI in FIG. 25.
Figure 25:
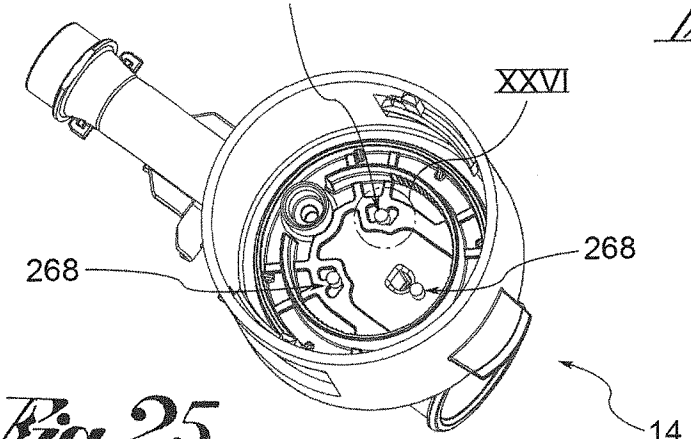
FIG. 25 shows a bottom view of the frame in FIG. 24.
Figure 23:
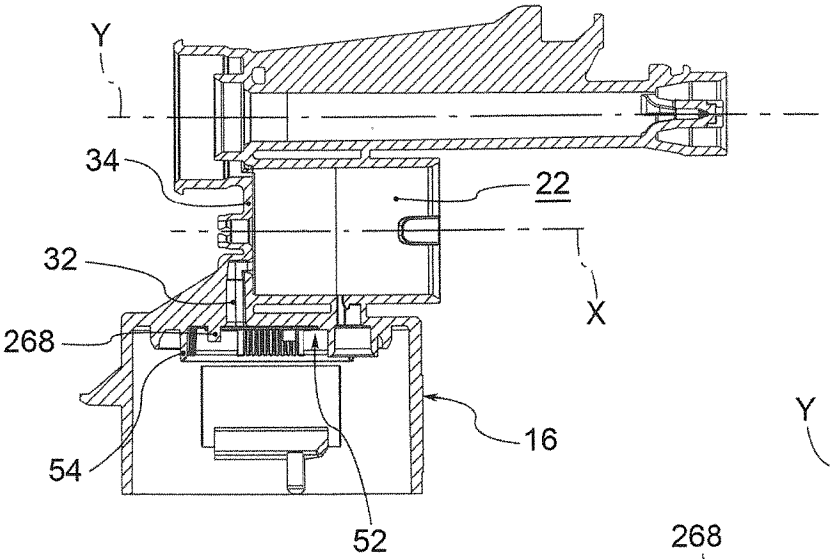
FIG. 23 shows a sectional view of a frame of the dispenser head in FIG. 21.
Figure 29:
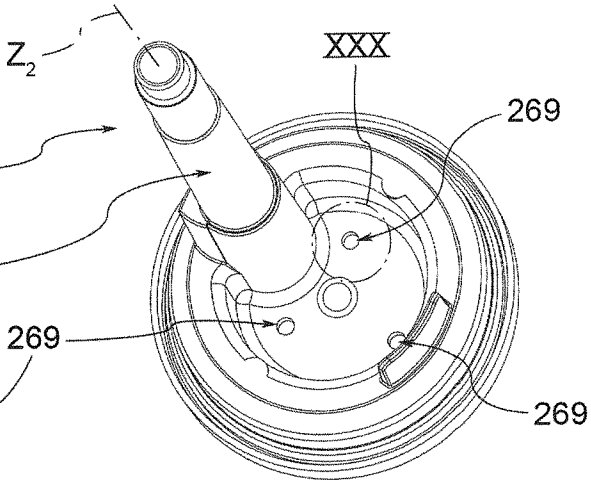
FIG. 29 shows a bottom view of the connector in FIG. 28.
Figure 30:
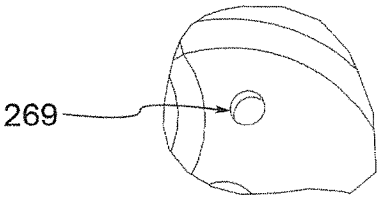
FIG. 30 shows an enlargement of detail XXX in FIG. 29.
Figure 28:
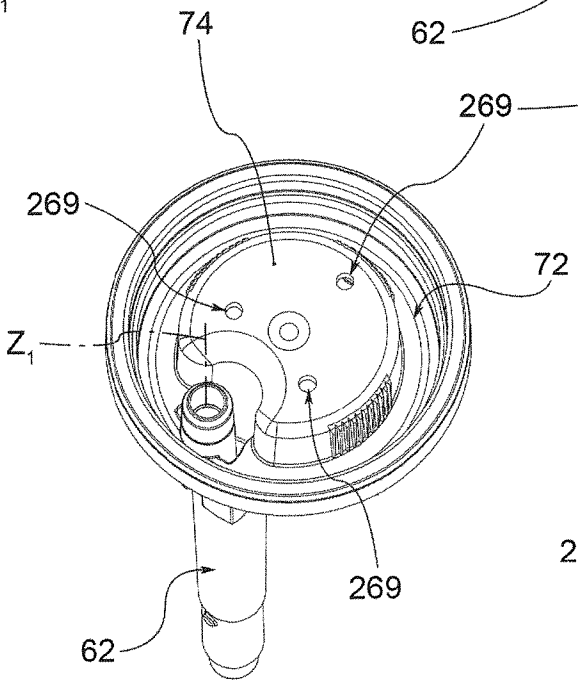
FIG. 28 shows a top view of the connector in FIG. 27.
Figure 27:
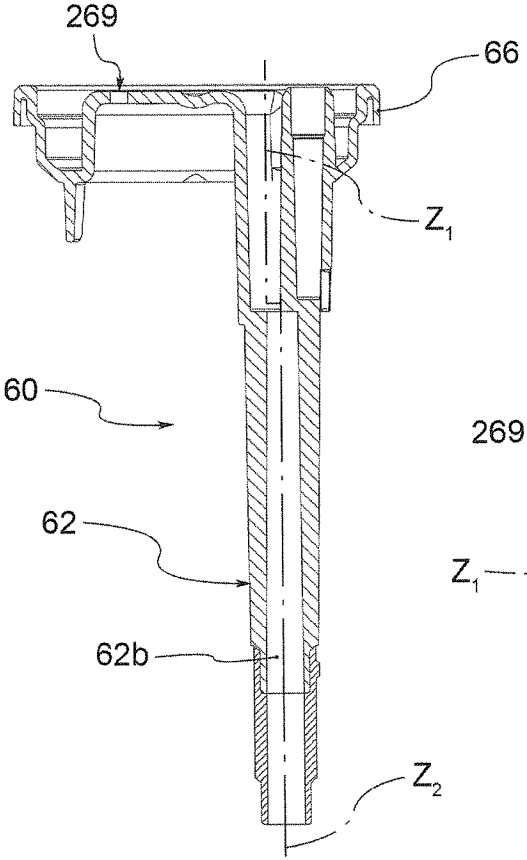
FIG. 27 shows a sectional view of a connector of the dispenser head in FIG. 21.
Figures 31, 32:
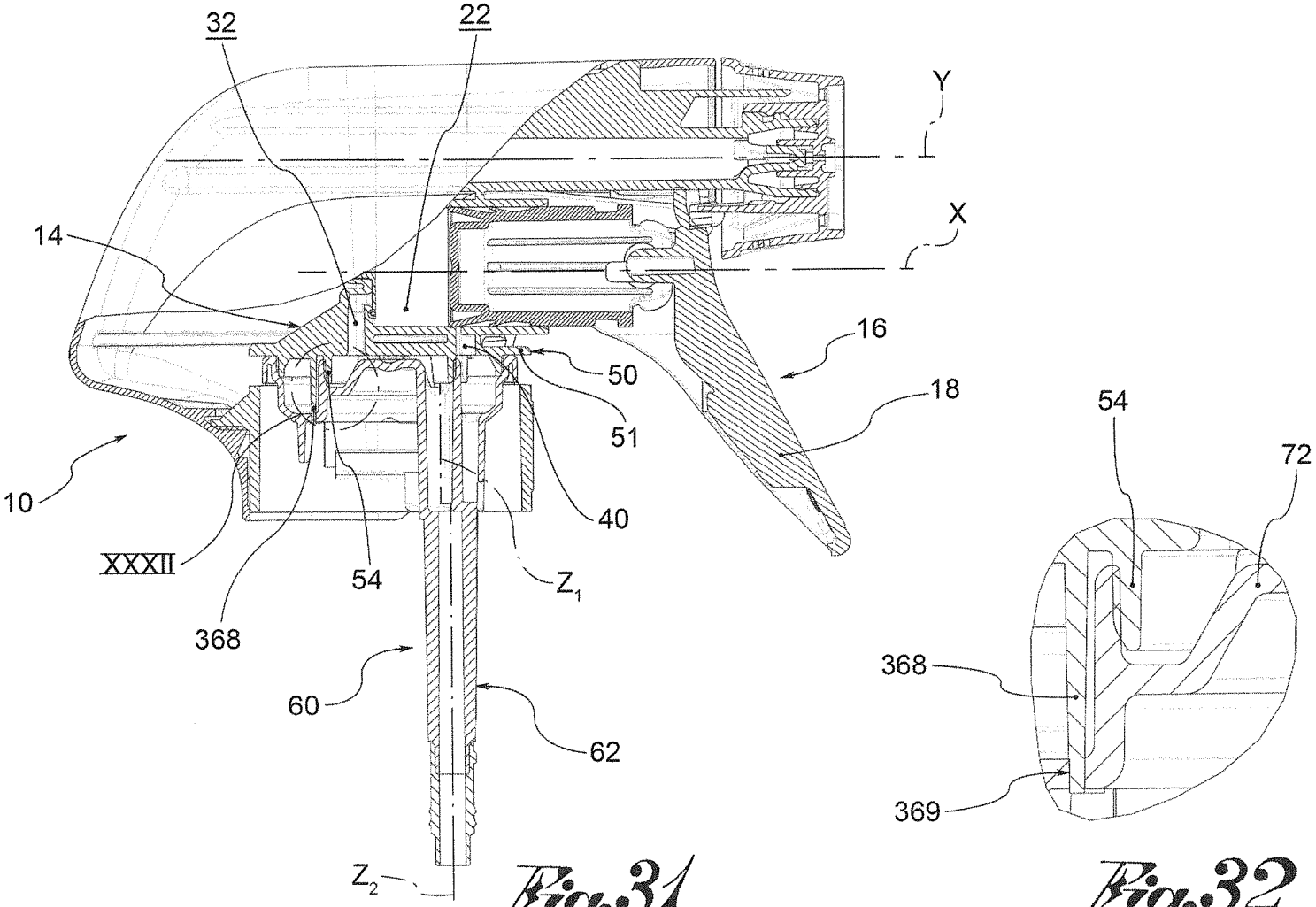
FIG. 31 shows a sectional view of a dispenser head of a dispenser device according to a further embodiment of the present invention.
FIG. 32 shows an enlargement of detail XXXII in FIG. 31.
Figure 34:
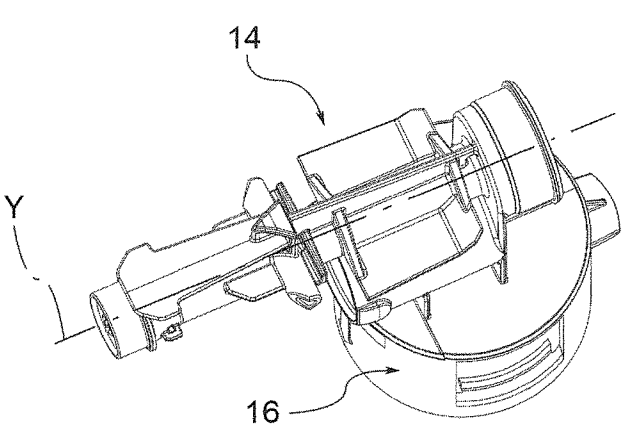
FIG. 34 shows a top view of the frame in FIG. 33.
Figure 36:
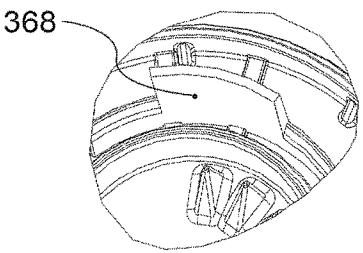
FIG. 36 shows an enlargement of detail XXXVI in FIG. 35.
Figure 35:
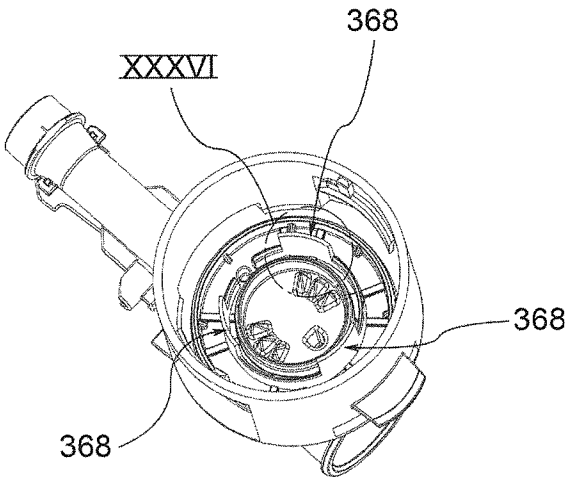
FIG. 35 shows a bottom view of the frame in FIG. 34.
Figure 33:
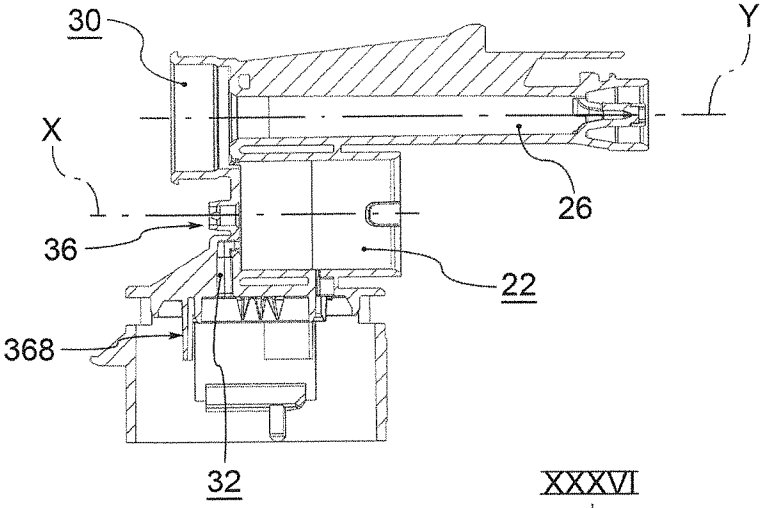
FIG. 33 shows a sectional view of a frame of the dispenser head in FIG. 31.
Figure 38:
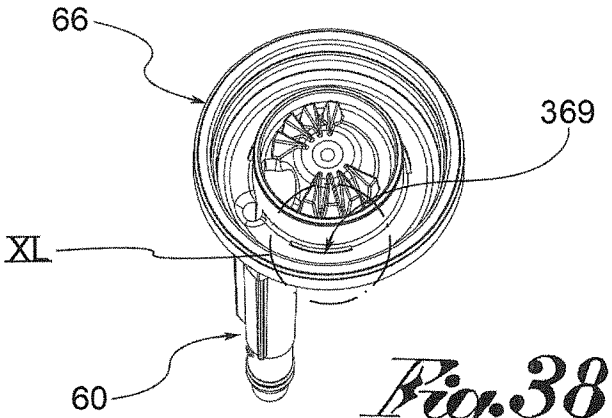
FIG. 38 shows a top view of the connector in FIG. 37.
Figure 40:
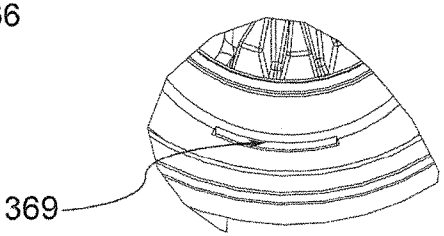
FIG. 40 shows an enlargement of detail XL in FIG. 39.
Figure 39:
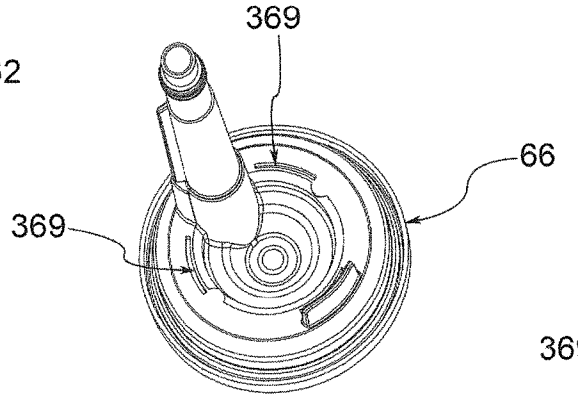
FIG. 39 shows a bottom view of the connector in FIG. 38.
Figure 37:
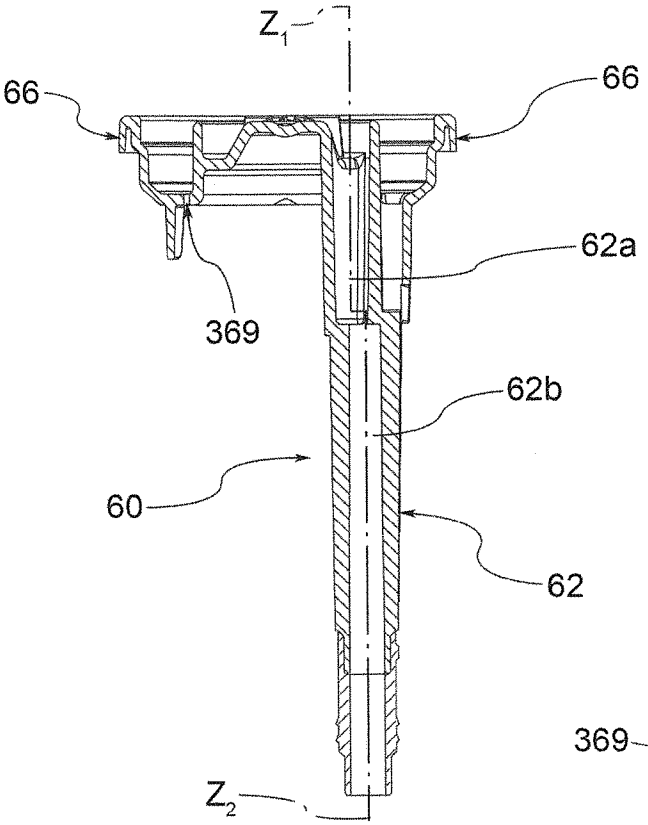
FIG. 37 shows a sectional view of a connector of the dispenser head in FIG. 31.
Figure 42:
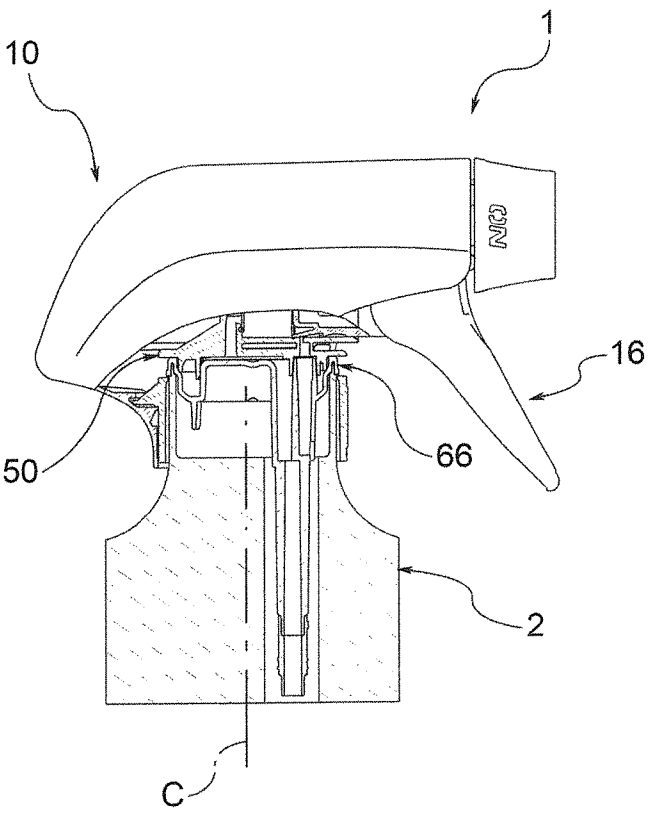
FIG. 42 shows the dispenser device in FIG. 41, with assembled dispenser head and bottle.
Figure 41:
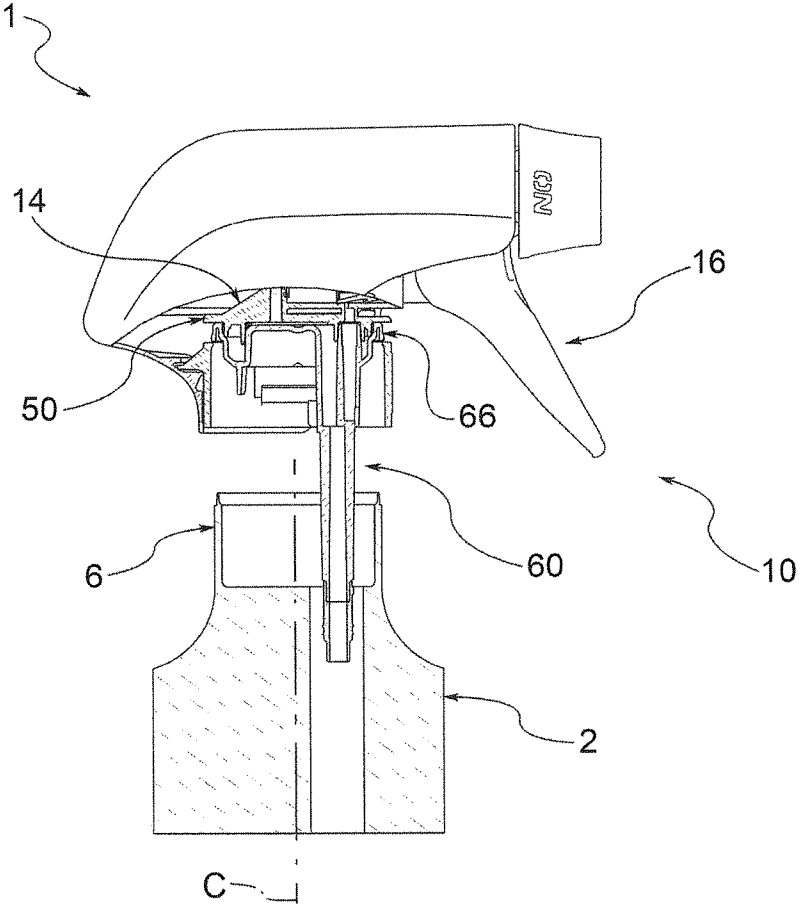
FIG. 41 shows a sectional view of a dispenser device according to a still further dispensing method, with separate dispenser head and bottle.

According to a further embodiment of the invention, connector 62 is connected to frame 14 via an irreversible connection by welding, for example, an ultrasound welding or a laser welding (FIGS. 21 to 42).

For example, according to a variant (FIGS. 21 to 30), frame 14 comprises at least one pin 268 projecting from the interface wall 50, and in particular projecting from the interface surface 52, and adapted to engage by welding with connector 60, and in particular with prominence 72 of said connector 60.

Preferably, frame 14 comprises three pins 268, equally angularly spaced, preferably arranged with their respective main axes on the same imaginary circumference, and preferably arranged radially inside the sealing wall 54 of frame 14, but preferably radially external to the suction mouth 32*a* and to the venting mouth 40*a*.

Correspondingly, connector 60 comprises at least one engagement seat 269, for example made on prominence 72, for example passing through the wall of said prominence 72.

According to further a variant (FIGS. 31 to 40), frame 14 comprises at least one tab 368 projecting from the interface wall 50, and in particular projecting from the interface surface 52, and adapted to engage by welding with connector 60, and in particular with a portion of the connector radially external to prominence 72.

Preferably, frame 14 comprises three tabs 368, having a predetermined circumferential extension, equally angularly spaced, preferably arranged on the same imaginary circumference, and preferably arranged radially outside the sealing wall 54 of frame 14.

Correspondingly, connector 60 includes at least one engagement slot 369, for example formed radially externally to prominence 72.

According to a still further variant (FIGS. 41 and 42), the peripheral annular wall 66 of connector 60 is connected by welding to frame 14, and in particular to the interface wall 50.

For example, the annular wall 66 is welded to the peripheral annular portion 51.

According to a further embodiment of the invention, the frame is connected to the connector by means of an adhesive, for example by introducing an adhesive film between the frame and the connector, such as a two-component epoxy glue.

Innovatively, the dispenser device according to the present invention allows a particularly fast and effective connection between the connector and the frame.

In particular, according to an advantageous aspect, the snap-free interference connection allows improving the production of large volumes since less accurate dimensional tolerances are required between the connected parts compared to snap connections.

It is clear that a man skilled in the art may make changes to the variants described above in order to meet incidental needs, all falling within the scope of protection defined in the following claims.

The invention claimed is:

1. Pre-assembled dispenser head for a dispenser device of a liquid, comprising:

a frame adapted to be releasably connected to a bottle of the device, said frame being adapted to support a trigger and functional components operable by said trigger for suction of the liquid from the bottle and dispensing of the liquid externally;

a connector, made separately from the frame and applied to said frame to form therewith an intermediate chamber for transit of the liquid from the bottle towards the frame, comprising a suction tube for the liquid contained in the bottle;

wherein the connector is connected to the frame by a snap-free connection in a reversible manner by an interference coupling, wherein the connector comprises at least one pin adapted to engage the frame with interference, and wherein the pin projects axially from an annular, peripheral wall of the connector;

wherein the connector comprises three pins, equally angularly spaced and arranged, with respective central axes of the three pins on a same imaginary circumference.

2. Head according to claim 1, wherein the pin is a conical shape so that insertion in the connector forms a progressive structural interference.

3. Pre-assembled dispenser head for a dispenser device of a liquid, comprising:

a frame adapted to be releasably connected to a bottle of the device, said frame being adapted to support a trigger and functional components operable by said trigger for suction of the liquid from the bottle and dispensing of the liquid externally;

a connector, made separately from the frame and applied to said frame to form therewith an intermediate chamber for transit of the liquid from the bottle towards the frame, comprising a suction tube for the liquid contained in the bottle;

wherein the connector is reversibly connected to the frame by a snap-free connection by an interference coupling, wherein the connector comprises at least one pin adapted to engage the frame with interference, and wherein the pin projects axially from an annular peripheral interference wall of the connector;

wherein the frame comprises at least one engagement hole, made in the interface wall, passing through said interface wall, and wherein said at least one engagement hole is made through a peripheral annular portion of the interface wall of the frame.

* * * * *